US006160977A

United States Patent [19]

Takeichi et al.

[11] Patent Number: 6,160,977

[45] Date of Patent: Dec. 12, 2000

[54] IMAGE FORMING APPARATUS AND DEVICE FOR APPLYING A LUBRICANT TO AN IMAGE

[75] Inventors: Ryuta Takeichi; Akiyo Nakajima, both of Kanagawa; Narihito Kojima, Shizuoka; Hiroshi Nagame, Shizuoka; Yohta Sakon, Shizuoka, all of Japan

[73] Assignee: Ricoh Company, Ltd., Tokyo, Japan

[21] Appl. No.: 09/447,953

[22] Filed: Nov. 29, 1999

[30] Foreign Application Priority Data

Nov. 27, 1998 [JP] Japan ..... 10-337784

[51] Int. Cl.[7] ..... G03G 15/00; G03G 21/00

[52] U.S. Cl. ..... 399/127; 399/346

[58] Field of Search ..... 399/127, 346, 399/348, 353, 123

[56] References Cited

U.S. PATENT DOCUMENTS

| | | | |
|---|---|---|---|
| 4,439,035 | 3/1984 | Landa | 399/348 |
| 5,264,903 | 11/1993 | Nagame et al. | 399/357 |
| 5,390,015 | 2/1995 | Nagame et al. | 399/356 |
| 5,452,061 | 9/1995 | Kojima et al. | 399/171 |
| 5,812,919 | 9/1998 | Takano et al. | 399/346 X |
| 6,014,532 | 1/2000 | Takeichi et al. | 399/346 X |
| 6,030,674 | 2/2000 | Onishi et al. | 399/123 |

FOREIGN PATENT DOCUMENTS

| | | |
|---|---|---|
| 7-120114 | 12/1995 | Japan . |
| 7-334058 | 12/1995 | Japan . |
| 8-248776 | 9/1996 | Japan . |

*Primary Examiner*—Fred L Braun

*Attorney, Agent, or Firm*—Oblon, Spivak, McClelland, Maier & Neustadt, P.C.

[57] ABSTRACT

In an image forming apparatus of the type sequentially executing charging, exposure, development and image transfer, a device for applying a lubricant to the surface of an image carrier includes a lubricant applying member rotatable in contact with the image carrier for applying, at a position where the lubricant applying member contacts the image carrier, the lubricant to the surface of the image carrier while deforming its contour in accordance with a bite of the surface of the image carrier. A lubricant feeding unit feeds the lubricant to the lubricant applying member and includes a lubricant providing unit having a preselected thickness t. The surface of the image carrier bites into the lubricant applying member by an amount T while the lubricant providing unit bites into the lubricant applying member by an amount t' smaller than the amount T, but substantially equal to or slightly greater than the thickness t. The device has a low cost, compact configuration and can use up the lubricant without any waste while desirably applying it to the image carrier.

19 Claims, 3 Drawing Sheets

IMAGE FORMING APPARATUS AND DEVICE FOR APPLYING A LUBRICANT TO AN IMAGE

BACKGROUND OF THE INVENTION

1. Field of the Invention

The present invention relates to an image forming apparatus and more particularly to a device for applying a lubricant to an image carrier included in an image forming apparatus.

2. Discussion of the Background

An image forming apparatus of the type sequentially executing charging, exposure, development and image transfer is extensively implemented as, e.g., a digital or an analog copier, laser printer or facsimile apparatus. This type of apparatus forms a latent image on a photoconductive element by charging and exposure and then develops the latent image to thereby form a corresponding toner image. The toner image is transferred from the photoconductive element to a paper or similar recording medium and then fixed on the recording medium.

The toner image is transferred from the photoconductive element to a recording medium either directly or by way of an intermediate transfer belt or similar intermediate transfer medium. The photoconductive element and intermediate transfer medium will be collectively referred to as an image carrier because each of them temporarily carries the toner image thereon.

Generally, not the entire toner image is transferred from the image carrier to a recording medium, i.e., part of toner remains on the image carrier after image transfer. It is therefore necessary to remove the toner left on the image carrier after image transfer. To meet this requirement, a cleaning blade or a cleaning brush is usually mechanically held in sliding contact with the surface of the image carrier. However, the cleaning blade and cleaning brush each cause the surface of the image carrier to wear. When the image carrier is implemented by a photoconductive element, the above wear deteriorates the characteristics of the element and thereby obstructs the formation of an expected latent image. When it comes to an intermediate transfer medium, the wear results in defective image transfer. To protect the image carrier from wear ascribable to cleaning, it is effective to reduce the coefficient of friction of the surface of the image carrier, as well known in the art. In light of this, it has been customary to apply a lubricant to the surface of the image carrier.

A conventional lubricant applying device includes a brush roller rotatable in a preselected direction while being pressed against the image carrier by a preselected pressure in the widthwise direction of the image carrier. A plurality of springs are used to press the lubricant against the brush roller with uniform pressure. The lubricant is sequentially consumed as it is repeatedly shaved off and applied to the image carrier. Although the lubricant decreases in thickness, the lubricant can be used up without any waste because it is constantly pressed against the brush roller by the springs.

However, when the lubricant is new and therefore thick, the lubricant is pressed against the brush roller by a pressure great enough for it to bite into the brush roller, causing the brush roller to noticeably deform. Particularly, when the image forming apparatus is left unused over a long period of time, e.g., at weekend or during vacation, the deformation of the brush roller ascribable to the bite of the lubricant remains. As a result, when the apparatus is used after a long interval, the brush roller fails to smoothly apply the lubricant to the image carrier until it restores its original configuration. This aggravates the wear of the image carrier. Further, the springs need an extra space to be accommodated and increase the number of parts that would obstruct the low cost, compact construction of the lubricant applying device.

Technologies relating to the present invention are disclosed in, e.g., Japanese Patent Laid-Open Publication Nos. 7-334058 and 8-248776 and Japanese Patent Publication No. 7-120114.

SUMMARY OF THE INVENTION

It is therefore an object of the present invention to provide a lubricant applying device capable of constantly applying a lubricant to an image carrier included in an image forming apparatus in a desirable manner without any waste.

It is another object of the present invention to provide a low cost, compact lubricant applying device for applying a lubricant to an image carrier included in an image forming apparatus. In accordance with the present invention, a device for applying a lubricant to an image carrier included in an image forming apparatus of a type sequentially executing charging, exposure, development and image transfer for temporarily carrying a toner image thereon includes a lubricant applying member. The lubricant applying member is rotatable in contact with the image carrier for applying, at a position where the lubricant applying member contacts the image carrier, the lubricant to the surface of the image carrier while deforming a contour thereof in accordance with the bite of the surface of the image carrier. A lubricant feeding device feeds the lubricant to the lubricant applying member and includes lubricant providing means having a preselected thickness t. The surface of the image carrier bites into the lubricant applying member by an amount T while the lubricant providing means bites into the lubricant applying member by an amount t' smaller than the amount T, but substantially equal to or slightly greater than the thickness t.

Also, in accordance with the present invention, an image forming apparatus for sequentially executing charging, exposure, development and image transfer includes an image carrier for temporarily carrying a toner image thereon, and a lubricant applying device for applying a lubricant to the surface of the image carrier and having the above unique construction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
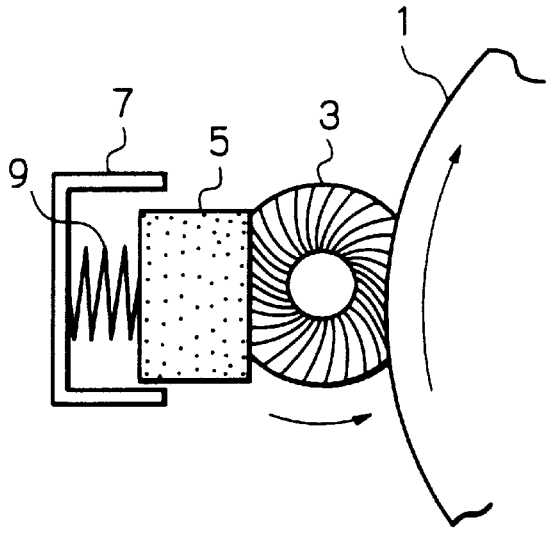
Fig. 1 PRIOR ART
FIG. 1 is a view showing a conventional lubricant applying device for an image forming apparatus.

To better understand the present invention, brief reference will be made to a conventional lubricant applying device, shown in FIG. 1. As shown, the lubricant applying device is generally made up of a brush roller or roller-like brush 3, a lubricant 5, a holder 7, and a spring 9. The reference numeral 1 designates an image carrier for temporarily carrying a toner image thereon and implemented as a photoconductive drum by way of example. The drum 1 is rotatable in a direction indicated by an arrow in FIG. 1.

The brush roller 3 is rotatable about a shaft, not shown, in a direction indicated by an arrow in FIG. 1. The brush roller 3 is pressed against the drum 1 by a preselected pressure in the widthwise direction of the drum 1 (perpendicular to the sheet surface of FIG. 1). Drive means, not shown, causes the brush roller 3 to rotate in the above direction. The lubricant 5 is held by the holder 7 and implemented by, e.g., solid zinc stearate in the form of a rod elongated in the direction perpendicular to the sheet surface of FIG. 1. The spring 9 constantly presses the lubricant 5 against the brush roller 3 in the lengthwise direction of the brush roller 3. When the brush roller 3 is rotated, it shaves off part of the lubricant 5 and applies the resulting powder to the circumferential surface of the drum 1. More specifically, a plurality of springs 9 are arranged at spaced locations in the length wise direction of the brush roller 3, so that the brush roller 3 is evenly pressed against the drum 1 in the lengthwise direction.

The lubricant 5 is sequentially consumed as it is repeatedly shaved off and applied to the drum 1. Although the lubricant 5 decreases in thickness, the lubricant can be used up without any waste because it is constantly pressed against the brush roller 3 by the springs 9. However, when the lubricant 5 is new and therefore thick, the lubricant 5 is pressed against the brush roller 3 by a pressure great enough for it to bite into the brush roller 3, causing the brush roller 3 to noticeably deform. This brings about the problem discussed earlier. Further, the springs 9 need an extra space for accommodating them, also bringing about the previously discussed problem.

Figure 2A:
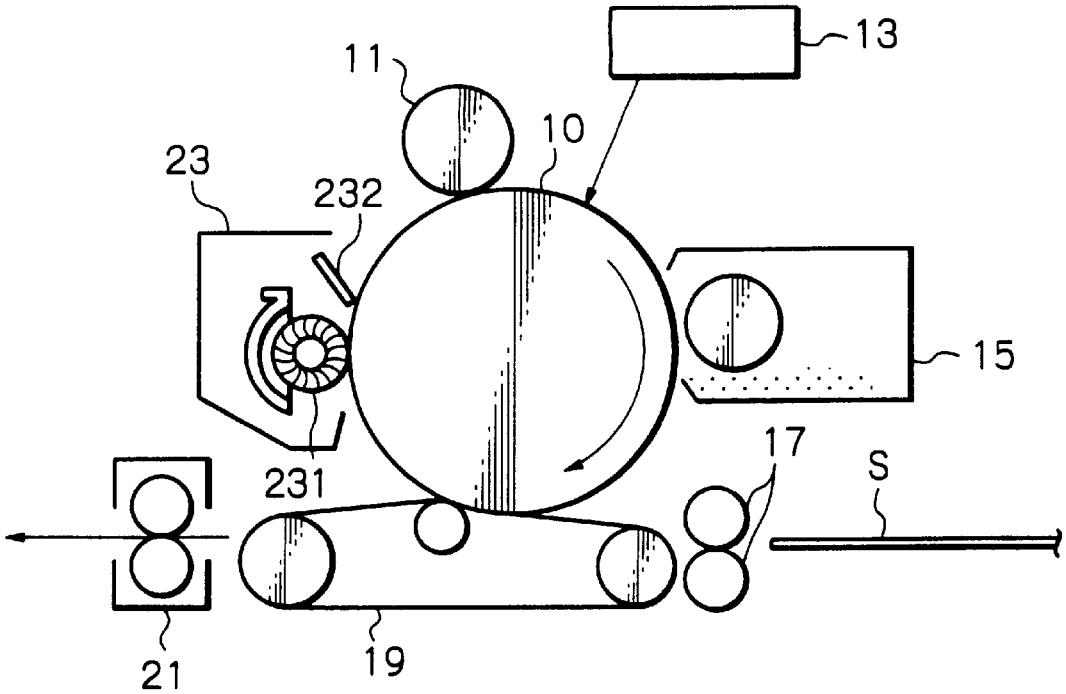
FIG. 2A is a view showing an image forming apparatus embodying the present invention.

Referring to FIG. 2A, an image forming apparatus embodying the present invention is shown and includes a photoconductive drum 10 which is a specific form of an image carrier. The drum 10 is rotated at a constant speed in a direction indicated by an arrow in FIG. 2A. Charging means 11 uniformly charges the surface of the drum 10. While the charging means 11 is implemented by a charge roller contacting the drum 10, it may alternatively be implemented by a corona charger not contacting the drum 10. An optical scanning unit 13 optically scans the charged surface of the drum 10 in accordance with image data so as to electrostatically form a latent image on the drum 10. A developing unit 15 develops the latent image with toner by reverse development and thereby forms a corresponding toner image.

A registration roller pair 17 conveys a paper, OHP (OverHead Projector) sheet or similar recording medium (sheet hereinafter) S to an image transfer position in synchronism with the rotation of the drum 10 carrying the toner image thereon. A transfer belt 19 conveys the sheet S toward a fixing unit 21 while the toner image is transferred from the drum 10 to the sheet S. The fixing unit 21 fixes the toner image on the sheet S. The sheet S with the fixed toner image is driven out of the apparatus.

After the above image transfer, a cleaning device 23 removes the toner and impurities including paper dust left on the surface of the drum 10. The cleaning device 23 includes a brush 231 and a blade 232.

Figure 2B:
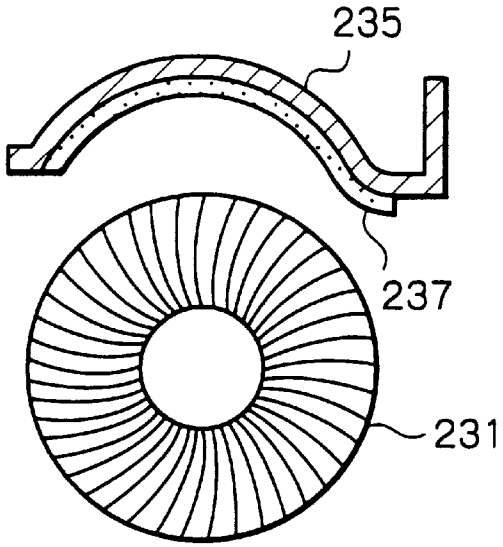
FIGS. 2B and 2C are views showing a lubricant applying device included in the illustrative embodiment.

The illustrative embodiment includes a lubricant applying device for applying a lubricant to the drum 10. In the illustrative embodiment, the brush 231 of the cleaning device 23 plays the role of a lubricant applying member. Specifically, as shown in FIG. 2B, the lubricant applying device is generally made up of the brush or lubricant applying member 231, a lubricant support member 235, and lubricant providing means 237.

Figure 2C:
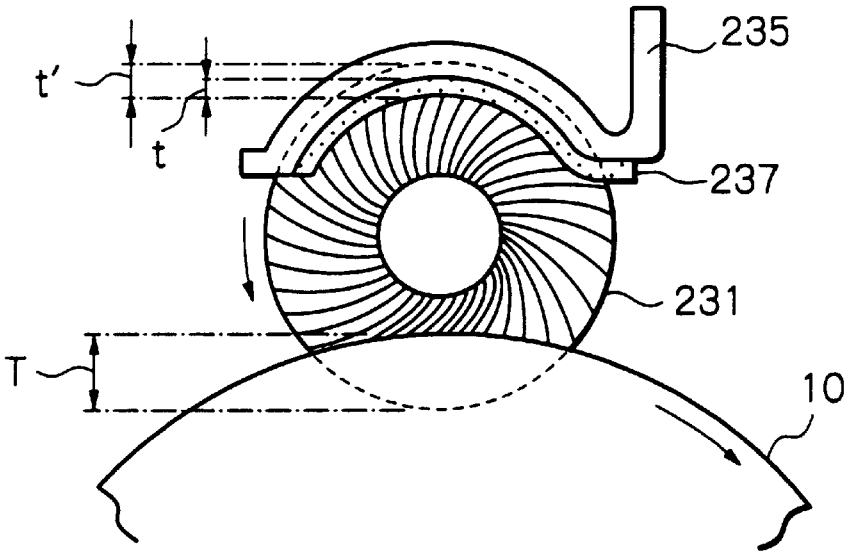

The brush 231 is implemented by a brush roller formed of, e.g., polyester resin or acrylic resin. As shown in FIG. 2C, the brush 231 is rotatable in contact with the surface of the drum 10 in the axial direction of the drum 10 (perpendicular to the sheet surface of FIG. 2C) so as to clean the surface of the drum 10. The lubricant support member 235 has a cross-section shown in FIG. 2B and extends in the direction perpendicular to the sheet surface of FIG. 2B while supporting the lubricant applying member 237 in the above direction. The lubricant providing member 237 held by the support member 235 is implemented as a sheet. The support member 235 is smoothly curved complementarily to the contour of the brush or lubricant applying member 231. The lubricant providing means 237 also has a curved surface complementary to the contour of the brush 231.

FIG. 2C shows a positional relation between the drum or image carrier 10, brush 231, lubricant support member 235, and lubricant applying means 237. The brush 231 is pressed against the image carrier 10 such that the former bites into the latter by a preselected amount T. The lubricant support member 235 presses the lubricant providing means 237 against the brush 231 such that the former bites into the latter by a preselected amount t'. The entire lubricant providing means 237 constructed integrally with the support member 235 is implemented by a sheet of non-liquid lubricant and has a thickness t. In the illustrative embodiment, the hold relations of $T>t'$, $t'\approx t$, and $t'>t$ hold. While the difference between t and t' is exaggerated in FIG. 2C, t and t' may, in practice, be almost the same as each other.

The amount T is so selected as to insure the optimal application of the lubricant to the drum 10, i.e., the lubricant applying member 231 is so configured as to insure such application of the lubricant. The applying member 231 can therefore be configured such that the drum 10 bites into the applying member 231, but does not cause the deformation of the applying member 231 to remain. In addition, because the thickness t of the lubricant providing means 237 is smaller than the amount T, the lubricant providing means 237 does not cause the deformation of the lubricant applying member 231 to remain despite the fact that the former bites into the latter.

Moreover, because the amount t' is substantially equal to or slightly greater than the thickness to the lubricant providing means 237, the lubricant providing means or lubricant 237 can be used up without any waste. In addition, because the lubricant providing means 237 does not have to be pressed against the brush 231 by springs, the lubricant applying device needs only a small number of parts and is therefore low cost and compact.

It should be noted that the lubricant is applied to the drum 10 in such a condition that the coefficient of static friction on the surface of the drum 10 is between 0.08 and 0.4.

As stated above, the lubricant applying device of the illustrative embodiment applies a lubricant to the image carrier 10 included in an image forming apparatus of the type sequentially executing charging, exposure, development, and image transfer. The lubricant applying member 231 is rotatable in contact with the image carrier 10 and applies the lubricant to the image carrier 10 while deforming in accordance with the amount of bite thereof into the image carrier 10. The lubricant support member 235 and lubricant providing means 237 constitute lubricant feeding means for feeding the lubricant to the lubricant applying member 231. The lubricant providing means 237 has the thickness t and bites into the lubricant applying member 231 by the amount t' smaller than the amount of bite T of the image carrier 10 into the applying member 231. The amount t' is substantially equal to or slightly greater than the thickness t.

The lubricant providing means 237 is held by the support member 235 and implemented as a sheet of non-liquid lubricant. The support member 235 is smoothly curved complementarily to the contour of the brush or lubricant applying member 231. The lubricant providing means 237 also has a curved surface complementary to the contour of the brush 231. It follows that the area over which the applying member 231 and providing means 237 contact each other can be increased or decreased on the basis of the configuration of the support member 235, as desired. This makes it possible to control the amount of application of the lubricant and easily implements an adequate coefficient of friction based on the balance between the amount of consumption and the amount of feed.

The lubricant providing means 237 may alternatively be implemented by silicone oil, PTFE powder or a similar non-solid lubricant contained in a piece of felt or sponge or similar support member having the thickness t. Further, the lubricant support member 235 may be coated with such a lubricant.

In the illustrative embodiment, the image carrier 10 to which the lubricant applying device applies the lubricant is implemented as a photoconductive element. The lubricant is applied to the photoconductive element such that the coefficient of static friction on the surface of the element is between 0.08 and 0.4. The lubricant applying member plays the role of a cleaning brush for cleaning the image carrier 10 at the same time.

If desired, the brush or lubricant applying member 231 may be replaced with the charge roller or charging means 11 or an independent lubricant applying member.

Figure 3:
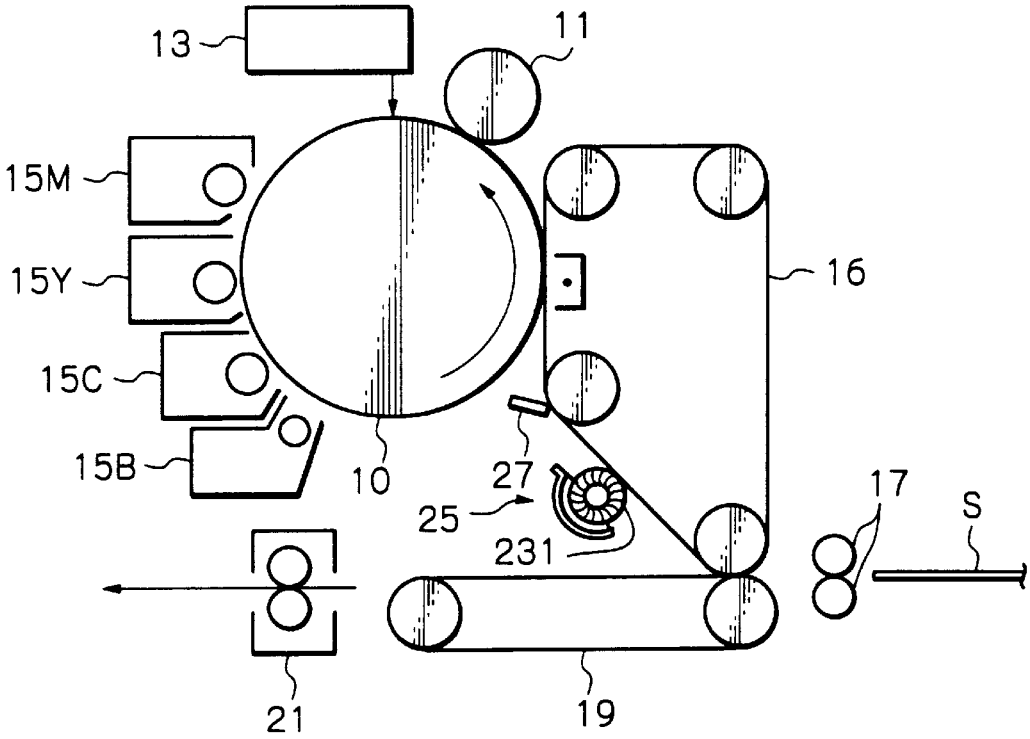
FIG. 3 is a view showing an alternative embodiment of the present invention.

Reference will be made to FIG. 3 for describing an alternative embodiment of the present invention. In FIG. 3, structural elements identical with the structural elements shown in FIG. 2A are designated by identical reference numerals and will not be described specifically in order to avoid redundancy. As shown, the charging means 11 uniformly charges the surface of the drum 10 rotating at a constant speed in a direction indicated by an arrow in FIG. 3. The scanning unit 13 optically scans the charged surface of the drum 10 in order to form, e.g., a magenta latent image on the drum 10. A developing unit 15M develops the magenta latent image to thereby form a magenta toner image. The magenta toner image is transferred from the drum 10 to an intermediate transfer belt or intermediate transfer medium 16.

The above procedure beginning with charging and ending with image transfer is repeated three more times. Specifically, the scanning unit 13 sequentially forms a yellow latent image, a cyan latent image and a black latent image on the drum 10. Developing units 15Y, 15C and 15B develop the yellow, cyan and black latent images, respectively, thereby forming a yellow, a cyan and a black toner image. The yellow, cyan and black toner images are sequentially transferred from the drum 10 to the intermediate transfer belt 16 over the magenta toner image existing on the belt 16, completing a full-color toner image.

The registration roller pair 17 conveys the sheet S to an image transfer position in synchronism with the movement of the intermediate transfer belt 16 carrying the full-color toner image thereon. While the transfer belt 19 conveys the sheet S, the toner image is transferred from the intermediate transfer belt 16 to the transfer belt 19. After the fixing unit 21 has fixed the toner image on the sheet S, the sheet is driven out of the apparatus. After the image transfer from the belt 16 to the sheet S, a cleaning device 25 removes the toner and impurities left on the surface of the belt 16. The cleaning unit 25 includes the brush 231 and a blade 27.

The transfer belt 19, brush 231 and blade 27 are released from the intermediate transfer belt 16 until the transfer of the full-color image from the drum 10 to the belt 11 ends.

In the illustrative embodiment, the intermediate transfer belt 16 plays the role of the image carrier for temporarily carrying a toner image thereon. The cleaning device or lubricant applying device 25 applies a lubricant to the intermediate transfer belt 16. Specifically, the brush 231 of the lubricant applying device 25 serves as a lubricant applying member in the same manner as in the previous embodiment.

As stated above, this embodiment differs from the previous embodiment in that the image carrier to which the lubricant applying means applies a lubricant is implemented by the intermediate transfer belt 16, and in that the lubricant applying member is implemented by the brush 231 for cleaning the belt 16.

A series of experiments were conducted with the image forming apparatus shown in FIG. 2A under the following conditions. The drum 10 was implemented by an OPC (Organic PhotoConductor) and was continuously rotated to output 200,000 images of A4 landscape size. The lubricant providing means 237 was implemented by a 2 mm thick sheet of solid PTFE. When the lubricant providing means 237 was used, the wear of the drum 10 was reduced to ¼, compared to a case not using the lubricant providing means 237. Even after the above continuous rotation of the drum 10, the various characteristics of the drum 10 including a charging characteristic did not change. Moreover, the lubricant or PTFE was fully used up.

Figure 4A:
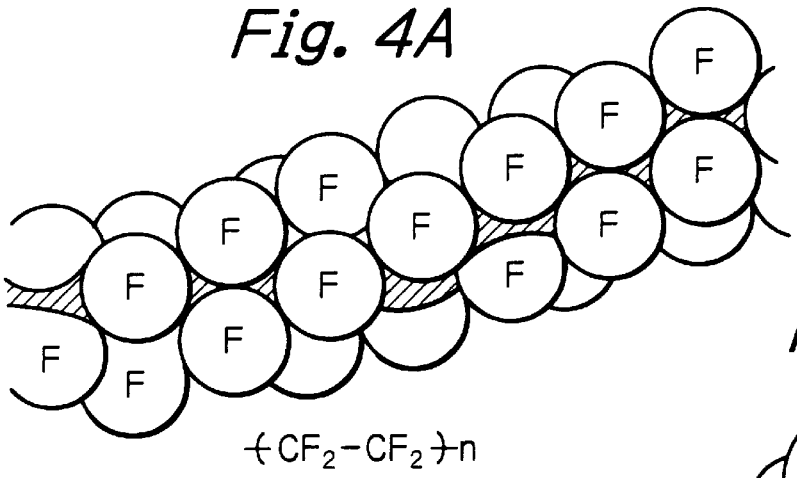
FIGS. 4A and 4B are respectively a perspective view and a sectional view showing the molecular structure of polytetrafluoroethylene (PTFE).
Figure 4B:
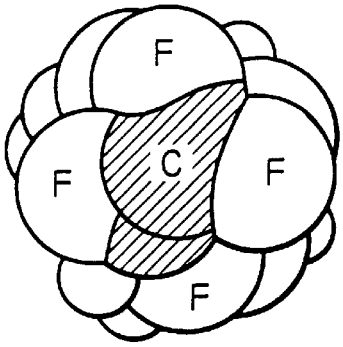

PTFE will be described specifically with reference to FIGS. 4A and 4B. As shown, PTFE is a fully symmetrical, linear high polymer in which a $CF_2$ unit simply repeats. Also, PTFE is nonpolar, has extremely low cohesion acting between its molecules, and has an extremely smooth surface on its molecule chain. PTFE therefore has a small coefficient of friction.

PTFE that is extremely soft and has small cohesion acting between its molecules, as stated above, allows the molecules to easily slip on each other. When PTFE of the lubricant providing means is applied to the surface of the image carrier, it partly deposits on, e.g., the cleaning blade. This part of PTFE intervenes between, e.g., the cleaning blade and the image carrier contacting each other. In this condition, the friction acting between PTFE molecules is the friction acting between the image carrier and the cleaning blade. Because the coefficient of friction between PTFE molecules is small, as stated above, a great shearing force ascribable to, e.g., the cleaning blade does not act on the image carrier. This is why the wear of the surface of the image carrier is successfully reduced.

After part of PTFE applied to the image carrier has deposited on the cleaning blade or similar member slidingly contacting the image carrier, the friction acting between PTFE molecules becomes predominant over the other friction acting between the cleaning blade and the image carrier. As a result, the wear of PTFE itself decreases because the coefficient of friction between PTFE molecules is extremely small. It therefore sometimes occurs that the amount of PTFE application is automatically limited and successfully prevented from exceeding a preselected amount, depending on the pressure and sliding condition between the image carrier and the above member.

The disarrangement of PTFE molecules occurs due to the friction between the molecules also. Therefore, the deposition of PTFE on the image carrier and the removal of tie former from the latter repeatedly occur in a certain ratio. The removal of PTFE is effected by, e.g., a cleaning unit, a developing unit, a sheet, etc. Usually, impurities ascribable to discharge and including NOx and SOx deposit on the surface of the photoconductive element and blur an image. If the lubricant is not applied to the photoconductive element, the impurities are removed at the same time that the surface layer of the element is shaved off (wear) by, e.g., a cleaning member. On the other hand, the lubricant applied to the photoconductive element is apt to reduce the wear of the image carrier to such a degree that the above impurities cannot be removed and bring about defective images. This problem can be solved with PTFE because PTFE repeatedly fed and removed allows the impurities to be repeatedly deposited and removed also.

The cruxes of the present invention will be summarized hereinafter. A lubricant applying device of the present invention applies a lubricant to an image carrier including in an image forming apparatus of the type sequentially executing charging, exposure, development and image transfer. The lubricant applying device includes a lubricant applying member and lubricant feeding means.

The lubricant applying member is rotatable in contact with the image carrier for applying the lubricant to the surface of the image carrier while deforming in accordance with a bite thereof into the surface of the image carrier. The lubricant applying member may advantageously be implemented by a brush roller preferably formed of, e.g., polyester resin or acrylic resin or an elastic roller formed of, e.g., foam sponge or rubber. The deformation of the lubricant applying member due to the above bite is caused by the bite of the image carrier. Specifically, the deformation is caused by elastic deformation when use is made of an elastic roller or caused by the elastic deformation of a brush when use is made of a brush roller.

The lubricant feeding means feeds the lubricant to the lubricant applying member and includes lubricant providing means. The lubricant providing means has a preselected thickness t. The lubricant providing means bites into the lubricant applying member by an amount t' smaller than an amount T by which the surface of the image carrier bites into the applying member (T>t'), but substantially equal to or slightly greater than the above thickness t.

As for the lubricant, use may be made of a liquid, solid, powdery or similar lubricant. A liquid lubricant may be silicone oil or fluorine oil while a solid lubricant may be PTFE, PFA, PVDF or similar fluorine-contained resin, silicone resin, polyolefine resin, silicone grease, fluorine grease, paraffin wax, zinc stearate or similar fatty acid metal salt, graphite, or molybdenum disulfide. A powdery lubricant may be the powder of the above solid lubricant. The liquid, solid or powdery lubricant may be used alone or in combination.

The lubricant providing means for feeding the lubricant to the lubricant applying member may be implemented by a non-liquid lubricant itself. Alternatively, the lubricant providing means may be implemented by a support member containing the non-solid lubricant (liquid or powder), e.g., a piece of felt impregnated with silicone oil or similar liquid lubricant and having the thickness t.

Further, the lubricant providing means may be implemented as a sheet supported by the lubricant support member, constituting lubricant feeding means. The word "sheet" refers to a flat member which is about 3 mm thick or less.

When the lubricant providing means is a non-liquid lubricant itself, the lubricant may be implemented as a sheet by any suitable method. For example, a sheet may be cut out from a molded or rolled mass of lubricant. Alternatively, the lubricant may be a foam sheet produced by molding or a sheet cut out from a foam body, in which case the lubricant providing means will have elasticity despite the sheet configuration.

As for the lubricant providing means implemented by a non-liquid lubricant itself, use may be made of a lubricant support member coated with the lubricant by, e.g., application or vapor deposition. The lubricant support member may be smoothly curved complementarily to the contour of the lubricant applying member, and the surface of the lubricant providing means may also be curved complementarily to the above contour.

The image forming apparatus of the present invention may be implemented as, e.g., an analog or a digital copier, laser printer, optical printer or facsimile apparatus by way of example.

The image carrier to which the lubricant applying device applies the lubricant may be implemented by a photoconductive element, in which case the lubricant should preferably be applied such that a coefficient of friction on the surface of the element is between 0.08 and 0.4, as measured by an Euler's belt system. In the Euler's belt system, a belt is implemented by high quality paper of medium thickness oriented such that its fibers extend in the lengthwise direction of the belt. After the belt has been wrapped around a cylindrical photoconductive element over one-fourth of the circumference, a preselected load W of, e.g., 100 g is applied to one end of the belt. A force gauge is connected to the other end of the belt. At the time when the belt starts moving, a coefficient of static friction $\mu s$ is calculated by use of the following equation:

$$\mu s = 2/\pi \times 1n\ (F/W)$$

where F is a reading of the force gauge.

The image carrier to be applied with the lubricant may be implemented as an intermediate image transfer belt via which a toner image is transferred from a photoconductive element to a sheet.

The lubricant applying member may also function as a cleaning brush included in a cleaning unit for cleaning the image carrier. That is, the lubricant applying member may be implemented by an exclusive lubricant applying member or by a cleaning brush or similar member joining in the image forming process. Of course, the member also functioning as the lubricant applying member should not have its original function obstructed by the application of the lubricant. Another specific member capable of also functioning as the lubricant applying member is a charge used to charge the photoconductive element.

The amount T of bite of the surface of the image carrier into the lubricant applying member is so selected as to insure the optimal application of the lubricant to the image carrier, i.e., the lubricant applying member is so configured as to insure such application of the lubricant. The applying member can therefore be configured such that the image carrier bites into the applying member, but does not cause the deformation of the applying member to remain. The thickness t of the lubricant providing means is smaller than the amount T. This, coupled with the fact that the amount t' of bite of the lubricant providing means into the lubricant applying member is substantially equal to or slightly greater than the thickness t, prevents the deformation of the lubricant applying member from remaining despite the bite of the lubricant providing means into the applying member.

Because the amount t' is substantially equal to or slightly greater than the thickness t, the lubricant providing means or lubricant can be used up without any waste. Because the lubricant providing means may be fixed in place, it does not have to be pressed against the lubricant applying member; a necessary pressure is available with the bite of the lubricant providing means into the lubricant applying member. Therefore, the lubricant applying device needs only a small number of parts and is therefore low cost and compact.

The lubricant providing means may be implemented as a sheet constituting lubricant feeding means in combination with the lubricant support member supporting it. This is successful to save space and reduce the size of the lubricant applying device, to allow a sheet to be cut to a required size, and to reduce the material cost when the sheet is cut to a minimum size While a solid lubricant is fragile and apt to warp to bring about irregular application, the lubricant providing means in the form of a sheet may be adhered or otherwise connected to the lubricant support member in order to obtain required rigidity.

When the lubricant providing means is implemented as one of supplies, it should only be replaced and adhered to the lubricant support member. This renders the replacement easy and cost-effective.

When the lubricant providing means is implemented as a layer or coating covering the lubricant support member, even a lubricant extremely fragile in a solid state can be easily and surely constructed integrally with the support member in the form of a sheet while achieving rigidity. In addition, coating is limited little by the configuration of a portion to be coated, so that the free configuration of the support member is promoted.

When the lubricant support member is smoothly curved complementarily to the contour of the lubricant applying member, and when the lubricant providing means also has a curved surface complementary to the above contour, the contact area between the applying member and the providing means can be increased or decreased, as desired. This makes it possible to control the amount of application of the lubricant and easily implements an adequate coefficient of friction based on the balance between the amount of consumption and the amount of feed.

As for the coefficient of friction between 0.08 and 0.4 unique to the present invention, coefficients of friction greater than 0.4 cannot prevent the wear of the surface of the photoconductive element due to the lubricant. While the coefficient of friction of 0.4 or less should preferably be maintained at all times, it may sometimes exceed 0.4. Further, the coefficient of friction may be between 0.3 and 0.1 that is desirable from the wear standpoint, as well known in the art. Coefficients of friction smaller than 0.08 would result in defective images due to the influence of ionized impurities.

In summary, in accordance with the present invention, a lubricant applying device is capable of applying a lubricant to an image carrier in a desirable manner at all times and allows the lubricant to be used up with a low cost compact construction. An image forming apparatus including the above lubricant applying means prevents an image carrier thereof from wearing and can form desirable images over a long period of time.

Various modifications will become possible for those skilled in the art after receiving the teachings of the present disclosure without departing from the scope thereof.

What is claimed is:

1. A device for applying a lubricant to an image carrier included in an image forming apparatus of a type sequentially executing charging, exposure, development and image transfer for temporarily carrying a toner image thereon, said device comprising:

a lubricant applying member rotatable in contact with the image carrier for applying, at a position where said lubricant applying member contacts said image carrier, the lubricant to a surface of said image carrier while deforming a contour of said lubricant applying member in accordance with a bite of said surface of said image carrier; and lubricant providing means for providing the lubricant to said lubricant applying member and having a preselected thickness t;

wherein the surface of the image carrier bites into said lubricant applying member by an amount T while said lubricant providing means bites into said lubricant applying member by an amount t' smaller than said amount T, but substantially equal to or slightly greater than the thickness t.

2. A device as claimed in claim 1, wherein said lubricant providing means comprises a non-liquid lubricant.

3. A device as claimed in claim 2, wherein said lubricant providing means comprises a sheet formed of the non-liquid lubricant and a lubricant support member supporting said sheet.

4. A device as claimed in claim 3, wherein said lubricant support member is smoothly curved complementarily to the contour of said lubricant applying member while said lubricant providing means has a surface curved complementarily to said contour.

5. A device as claimed in claim 3, wherein said lubricant providing means comprises said lubricant support member coated with the lubricant.

6. A device as claimed in claim 2, wherein the lubricant comprises polytetrafluoroethylene (PTFE).

7. A device as claimed in claim 1, wherein the lubricant comprises a non-solid lubricant, said lubricant providing means comprising a support member having a thickness t.

8. A device as claimed in claim 7, wherein said lubricant providing means comprises a sheet formed of the non-solid lubricant and a lubricant support member supporting said sheet.

9. A device as claimed in claim 8, wherein said lubricant support member is smoothly curved complementarily to the contour of said lubricant applying member while said lubricant providing means has a surface curved complementarily to said contour.

10. A device as claimed in claim 7, wherein the lubricant comprises PTFE.

11. A device as claimed in claim 1, wherein said lubricant providing means comprises a sheet formed of the lubricant and a lubricant support member supporting said sheet.

12. A device as claimed in claim 11, wherein the lubricant comprises PTFE.

13. A device as claimed in claim 11, wherein said lubricant support member is smoothly curved complementarily to the contour of said lubricant applying member while said lubricant providing means has a surface curved complementarily to said contour.

14. A device as claimed in claim 1, wherein the lubricant comprises PTFE.

15. An image forming apparatus for sequentially executing charging, exposure, development and image transfer, said image forming apparatus comprising:

an image carrier for temporarily carrying a toner image thereon; and a lubricant applying device for applying a lubricant to a surface of said image carrier;

said lubricant applying device comprising:

a lubricant applying member rotatable in contact with the image carrier for applying, at a position where said lubricant applying member contacts said image carrier, the lubricant to the surface of said image carrier while deforming a contour of said lubricant applying member in accordance with a bite of said surface of said image carrier; and lubricant providing means for providing the lubricant to said lubricant applying member and having a preselected thickness t;

wherein the surface of the image carrier bites into said lubricant applying member by an amount T while said lubricant providing means bites into said lubricant applying member by an amount t' smaller than said amount T, but substantially equal to or slightly greater than the thickness t.

16. An apparatus as claimed in claim 15, wherein said image carrier comprises a photoconductive element.

17. An apparatus as claimed in claim 16, wherein the lubricant is applied to said photoconductive element such that a coefficient of static friction on the surface of said photoconductive element is between 0.08 and 0.4.

18. An apparatus as claimed in claim 15, wherein said image carrier comprises an intermediate image transfer medium via which a toner image is transferred from said photoconductive element to a recording medium.

19. An apparatus as claimed in claim 15, wherein said lubricant applying member bifunctions as a brush included in a cleaning device for cleaning said image carrier.

* * * * *

UNITED STATES PATENT AND TRADEMARK OFFICE

CERTIFICATE OF CORRECTION

PATENT NO. : 6,160,977

DATED : December 12, 2000

INVENTOR(S): Ryuta TAKEICHI, et al.

It is certified that an error appears in the above-identified patent and that said Letters Patent is hereby corrected as shown below:

On the title page, item [54] and column 1, the title of invention is incorrect, item [54] and column 1 should read as follows:

--[54] IMAGE FORMING APPARATUS AND DEVICE FOR APPLYING A LUBRICANT TO AN IMAGE CARRIER--

Signed and Sealed this

First Day of May, 2001

*Attest:*

Nicholas P. Godici

NICHOLAS P. GODICI

*Attesting Officer*

*Acting Director of the United States Patent and Trademark Office*